US005822169A

United States Patent [19]

Yoshioka et al.

[11] Patent Number: 5,822,169

[45] Date of Patent: Oct. 13, 1998

[54] CONTACT CHARGING DEVICE

[75] Inventors: Kenjiro Yoshioka; Hidetsugu Shimura, both of Nagano, Japan

[73] Assignee: Seiko Epson Corporation, Tokyo, Japan

[21] Appl. No.: 578,934

[22] Filed: Dec. 27, 1995

[30] Foreign Application Priority Data

| | | | |
|---|---|---|---|
| Dec. 27, 1994 | [JP] | Japan | 6-325634 |
| Apr. 10, 1995 | [JP] | Japan | 7-083765 |
| Apr. 20, 1995 | [JP] | Japan | 7-095721 |
| Nov. 16, 1995 | [JP] | Japan | 7-322143 |

[51] Int. Cl.[6] ..... G03G 15/02

[52] U.S. Cl. ..... 361/225; 399/174

[58] Field of Search ..... 355/219; 361/225; 399/174, 176

[56] References Cited

U.S. PATENT DOCUMENTS

| | | | |
|---|---|---|---|
| 4,380,384 | 4/1983 | Ueno et al. . | |
| 5,243,387 | 9/1993 | Ikegawa | 355/219 |
| 5,453,819 | 9/1995 | Shimura et al. | 355/219 |
| 5,534,344 | 7/1996 | Kisu et al. | 355/219 X |

FOREIGN PATENT DOCUMENTS

| | | | |
|---|---|---|---|
| A20554114 | 8/1993 | European Pat. Off. . | |
| 4268584 | 9/1992 | Japan . | |
| 05072869 | 3/1993 | Japan | 355/219 |
| 06149004 | 5/1994 | Japan | 355/219 |
| 06274004 | 9/1994 | Japan | 355/219 |

*Primary Examiner*—Robert Beatty

*Attorney, Agent, or Firm*—Sughrue,Mion,Zinn,Macpeak & Seas, PLLC

[57] ABSTRACT

A contact charging device includes: a member to be charged rotatably provided; a conductive member having a soft endless thin film shape, for charging or discharging the member to be charged such that the conductive member is electrostatically attracted to the member to be charged as the member rotates; and a supporting member, disposed apart from the member to be charged, for holding the conductive member while resisting the electrostatic attracting force such that the conductive member is stretched, to allow the conductive member to rotate together with the member to be charged.

18 Claims, 9 Drawing Sheets

CONTACT CHARGING DEVICE

BACKGROUND OF THE INVENTION

The present invention relates to a contact charging device in use with an image forming apparatus based on the electrophotography technique, such as a printer, a facsimile or a copying machine. More particularly, the invention relates to a contact charging device for charging or discharging a member to be charged in a manner that a charging member applied with a voltage is brought into contact with the member to be charged.

In a known contact charging device for the electrophotography-basis image forming apparatus, a conductive blade, a conductive tube, or a conductive elastic roller is used for the charging member, and brought into contact with the member to be charged in a state that a voltage is applied to the charging member.

The contact charging device of the type in which the blade is used for the charging member, is advantageous in that the construction is simple and the size is reduced, but is disadvantageous in that the surface of the member to be charged is damaged by rubbing the blade against the member to be charged, and direct charge injection takes place, to thereby making the charging operation instable and nonuniform. The contact charging device of the type in which the conductive brush is used is advantageous in that the damage of the surface of the member to be charged is suppressed, but disadvantageous in that charge is directly injected into the member to be charged through the contact of the brush with the member, whereby an irregularity of the charging operation is shaped like a sweeping with the brush, and an improper charging operation is performed in part. The contact charging device of the type in which the conductive roller is used is advantageous in that a stable and uniform charging operation is ensured but is disadvantageous in that a strong contact force deforms the roller, leading to improper charging operation.

A solution to the above problems is disclosed in Japanese Patent Laid-Open Publication No. Hei. 5-72869. In the publication, to charge the photosensitive drum, a thin conductive tube is driven to move by a roller in a state that it is put into contact with a photosensitive drum. The technique is advantageous in that the charging operation is effectively performed without impairing the surface of the photosensitive drum, but has the following disadvantage. When a slight difference is created between the peripheral speed of the roller and that of the photosensitive drum, a nip position where the conductive tube comes in contact with the surface of the photosensitive drum, shifts or an air gap located before and after the nip position in the discharging region varies, to thereby losing the uniform charging operation.

SUMMARY OF THE INVENTION

Accordingly, an object of the present invention is to provide a contact charging device which uniformly charges or discharges a photosensitive drum without impairing the photosensitive drum.

To achieve the above object, there is provided a contact charging device includes: a member to be charged rotatably provided; a conductive member having a soft endless thin film shape, for charging or discharging the member to be charged such that the conductive member is electrostatically attracted to the member to be charged during the member rotates; and a supporting member, disposed apart from the member to be charged, for holding the conductive member while resisting the electrostatic attracting force such that the conductive member is stretched, to thereby allow the conductive member to rotate following the rotation of the member to be charged.

DETAILED DESCRIPTION OF THE PREFERRED EMBODIMENTS

The preferred embodiments of the present invention will be described.

Figure 1:
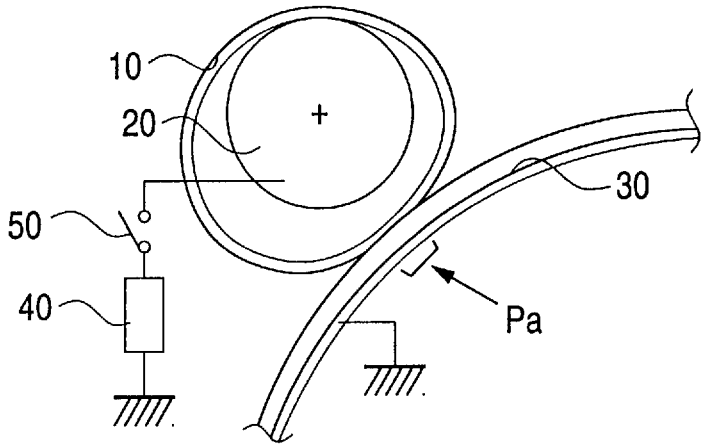
FIGS. 1(*a*) and 1(*b*) show an embodiment of a contact charging device according to the present invention when it is in an operating state and a non-operating state.
Figure 1:
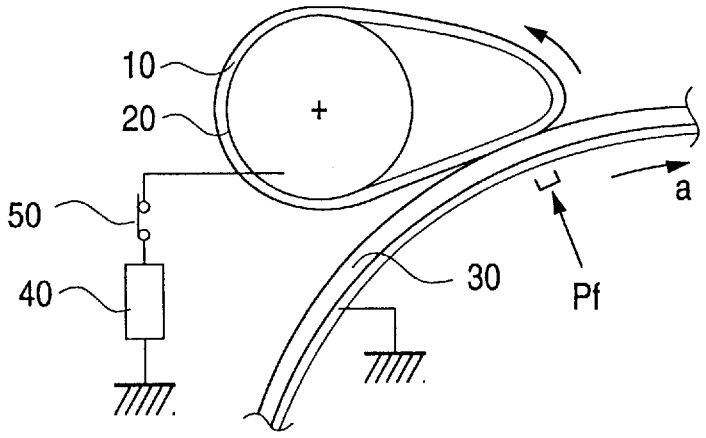

A contact charging device according to an embodiment of the present invention and the principle of the contact charging device are diagrammatically shown in FIGS. 1(*a*), 1(*b*) and 2.

In the figures, reference numeral 10 designates a conductive tube as a conductive member, which is put into contact with the surface of a photosensitive drum 30 as a member to be charged, to thereby charge uniformly the entire surface thereof. The conductive tube 10 is supported by a supporting member 20, which is disposed apart from the photosensitive drum 30. The conductive tube 10, while being supported so, is electrostatically attracted onto the surface of the photosensitive drum 30, and rotates in the direction indicated by an arrow a following the rotation of the photosensitive drum without any slippage of the conductive tube to the drum. Such a rotation of the conductive tube 10 will be referred to as a following-rotation. In this state, the conductive tube 10 uniformly charges the entire surface of the conductive tube 10.

The conductive tube 10 is an endless band that may be shaped so as to depict an ellipse of which one of the focuses is substantially coincident with the center of the supporting member 20, when it is supported by the supporting member 20 in a free state. The conductive tube 10 is made of a thin film member which is conductive and soft. The coefficient of static friction of the conductive tube 10 is 0.1 or larger when it is in contact with the photosensitive drum 30. The conductive tube 10 is wide enough to cover the effective image area of the photosensitive drum 30.

The conductive tube 10 receives a voltage from a power source 40, which is connected through a switch 50 to the supporting member 20. When applying the voltage, the conductive tube 10 uniformly charges the entire surface of the photosensitive drum 30.

The supporting member 20, which supports the conductive tube 10, must be designed so as to allow the conductive tube 10 to rotate together with the photosensitive drum 30 without any motion of the conductive tube 10 relative to the photosensitive drum 30. Where the supporting member 20 is a rod circular in cross section, fixedly disposed, it is necessary that the frictional force exerted between the surface of the supporting member 20 and the conductive tube 10 is smaller than that between the conductive tube 10 and the photosensitive drum 30. To this end, the surface of the supporting member 20 is coated with a material of small friction coefficient, such as fluorine resin.

The operation of the contact charging device thus constructed and the principle of the same will be described.

Figure 2:
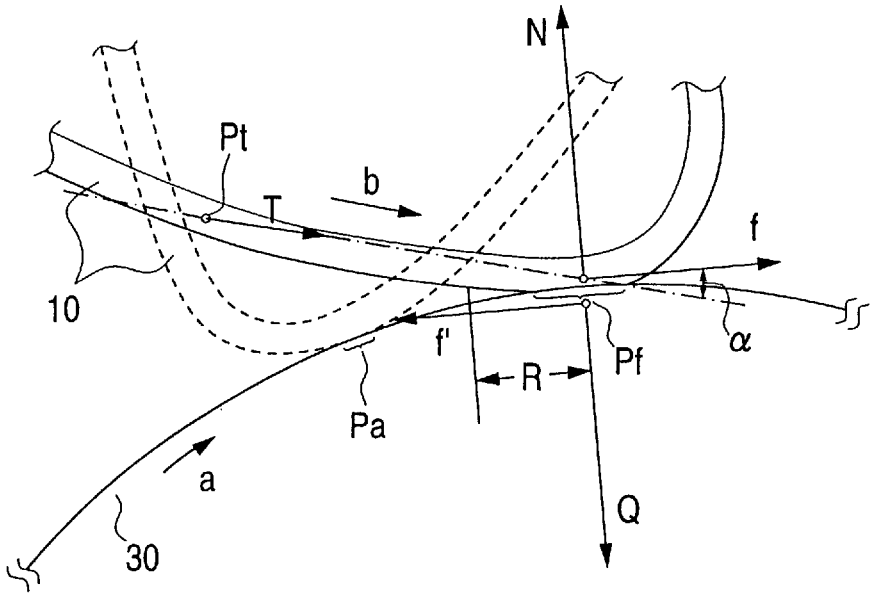
FIG. 2 shows the principle of the contact charging device of FIG. 1.

In an inoperative state of the contact charging device where no voltage is applied to the conductive tube 10, and the photosensitive drum 30 is at a standstill, a part of the conductive tube 10, which is supported by the supporting member 20, is in contact with a position Pa on the surface of the photosensitive drum 30, as shown in FIG. 1(*a*) or FIG. 2 (in which the conductive tube 10 is indicated by broken lines).

When the photosensitive drum 30 starts to rotate and a voltage is applied to the conductive tube 10, the conductive tube 10 is electrostatically attracted onto the surface of the photosensitive drum 30, and is moved in the rotating direction of the drum since a frictional force acts therebetween and reaches another position Pf, as shown in FIG. 1(*b*) or indicated by solid lines in FIG. 2.

In FIG. 2, Q indicates a contact force of the conductive tube 10 when it is put into contact with the photosensitive drum 30; f and f', frictional forces; N, a vertical reaction of the photosensitive drum 30 acting on the conductive tube 10; Pt, a point where a tension acts on the conductive tube 10; T, a tension acting on the conductive tube 10; and $\alpha$, an angle between the action lines of the tension T and the frictional force f.

A tension T acting on the conductive tube 10 is given by $$T=f\cdot\cos\alpha$$

The frictional forces f and f' are given by $\mu$N where $\mu$ is the coefficient of static frictional force between the conductive tube 10 and the photosensitive drum 30.

Hence, the relationship between the tension T and the contact force Q is expressed by $$T=\mu Q\cdot\cos\alpha$$

When the photosensitive drum 30 starts to rotate in the direction of the arrow a and the voltage is applied to the conductive tube 10, a frictional force f proportional to a vertical reaction N acts on the conductive tube 10. The contact position where the conductive tube 10 is in contact with the photosensitive drum 30 shifts from the position Pa to the position Pf. At the same time, the conductive tube 10 receives the tension T between the supporting member 20 and the contact area Pf, and is stretched. The angle $\alpha$ between the action lines of the tension T and the frictional force f is reduced to a minimum. As a result, a discharge region R providing a stable charging action is formed.

At the same time, the conductive tube 10 is bent between the supporting member 20 and the contact area Pf. Then, a small discharge area where the charging action is performed is also formed in a portion subsequent to the contact area Pf.

When the tension T exceeds a rotation impeding force of the conductive tube 10, or a frictional force which acts between it and the supporting member 20, the conductive tube 10 starts to rotate together with the photosensitive drum 30 without any motion of it relative to the photosensitive drum 30 and irrespective of the magnitude of the contact force Q, and stably charges the surface of the photosensitive drum 30 without damaging the surface, while overriding the toner and paper powder left on the surface of the photosensitive drum 30.

When the contact position of the conductive tube 10 where it is electrostatically attracted to the photosensitive drum 30 is shifted from the position Pa to the position Pf, which is located downstream of the position Pa when viewed in the direction of the rotate of the photosensitive drum 30, the tension T is caused in the conductive tube 10 between it and the supporting member 20. With the tension T, the conductive tube 10 is stretched, so that a stable discharge gap is uniformly formed while minutely decreasing toward the downstream part of the photosensitive drum 30 when viewed in the rotate direction of the drum.

An electrostatic attracting force Fq which acts between the conductive tube and the photosensitive drum is expressed by $$Fb=\epsilon\cdot\epsilon o\cdot Vth^2/(2d^2)$$

where $\epsilon$=relative dielectric constant, $\epsilon o$=dielectric constant in vacuum, Vth=charge starting voltage relative to the photosensitive drum, and d=thickness of the photosensitive layer of the photosensitive drum.

When a voltage is applied to the conductive tube 10, the conductive tube 10 that is at a standstill starts to move if the following conditions are satisfied:

1) When the supporting member is fixed, $$\mu tp\cdot(Fq+Fn)>\mu ts\cdot Fts$$

Preferably $\mu tp\geqq 0.1$ and $\mu ts\leqq 0.7$, more preferably $\mu tp>\mu ts$.

2) When the supporting member is rotatable, $$\mu tp\cdot(Fq+Fn)>\mu js\cdot Fjs$$

Preferably $\mu tp\geqq 0.1$ and $\mu ts\leqq 0.7$, more preferably $\mu tp>\mu js$.

In the above expressions, $\mu$tp: coefficient of static friction between the conductive tube and the photosensitive drum, Fq: electrostatic attracting force exerted between the conductive tube and the photosensitive drum, Fn: mechanical contact force between the conductive tube and the photosensitive drum, $\mu$ts: coefficient of static friction between the conductive tube and the supporting member, Fts: contact force of the conductive tube to the supporting member, $\mu$js: coefficient of static friction between a bearing (to be described later) and the supporting member, and Fjs: bearing supporting force of the supporting member.

After the conductive tube starts to move, it is stably rotated in the company of the photosensitive drum if the following conditions are satisfied:

1) When the supporting member is fixed, $$\mu tp\cdot(Fq+Fn)>\mu mts\cdot Fts$$

Preferably $\mu tp\geqq 0.1$ and $\mu mts\leqq 0.6$, more preferably $\mu tp>\mu mts$.

2) When the supporting member is rotatable, $$\mu tp\cdot(Fq+Fn)>\mu mjs\cdot Fjs$$

Preferably $\mu tp\geqq 0.1$ and $\mu mjs\leqq 0.6$, more preferably $\mu tp>\mu mjs$.

In the above expressions, $\mu$mts: coefficient of dynamic friction between the conductive tube and the supporting member, and $\mu$mjs: coefficient of dynamic friction between bearing and the supporting member.

In order to secure a sufficiently large frictional force f and a stable following-rotation of the conductive tube 10, it is necessary to increase the electrostatic attracting force Fq acting between the conductive tube 10 and the photosensitive drum 30. To increase the electrostatic attracting force Fq, it is preferable to use a photosensitive belt specified: Vth (charge starting voltage)≧300 V and d (thickness of the photosensitive layer)≦50 $\mu$m.

Figure 3:
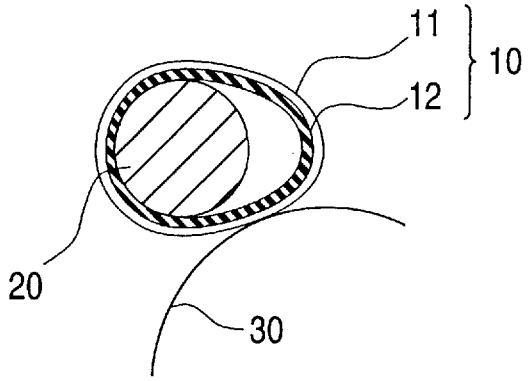
FIGS. 3(*a*) to 3(*c*) show other supporting means available for the contact charging device of the invention.
Figure 3:
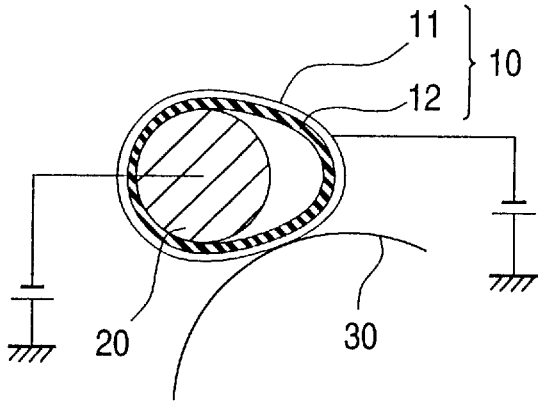
Figure 3:
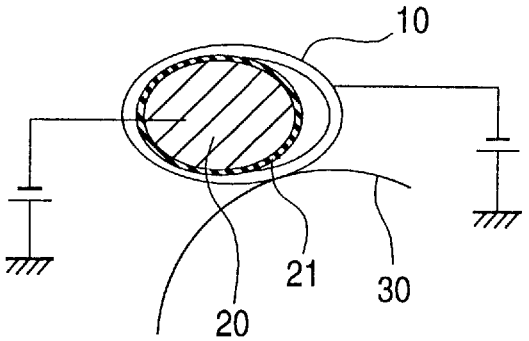

FIGS. 3(*a*) to 3(*c*) diagrammatically illustrates three instances of a means to secure a stable following-rotation of the conductive tube, which is available for the contact charging device of the present embodiment. In the instance of FIG. 3(*a*), the conductive tube 10 has a layered structure comprising a conductive, outer layer 11 of a large friction coefficient to the photosensitive drum 30, and an inner layer 12 made of a material of a small friction coefficient to the supporting member 20. With such a layered structure, the conductive tube 10 is able to stably rotate together with the photosensitive drum.

In the instance of FIG. 3(*b*), the conductive tube 10 has also a layered structure, which consists of an outer layer 11 made of conductive material and an inner layer 12 made of insulating material. A bias voltage of the same polarity as of the voltage applied to the outer layer 11 is applied to the supporting member 20. The resultant electrostatic repulsion reduces a frictional force which acts between the conductive tube 10 and the supporting member 20.

In the instance of FIG. 3(*c*), an insulating layer 21 is layered over the surface of the supporting member 20 made of conductive material. A bias voltage of the same polarity as of the voltage of the conductive tube 10 is applied to the supporting member 20. The resultant electrostatic repulsion reduces a frictional force which acts between the conductive tube 10 and the supporting member 20.

In the above-mentioned instances, the supporting members 20 are of the fixed type. Each supporting member 20 may be a hollow cylindrical body, formed from a sheet of thin plate.

Figure 4:
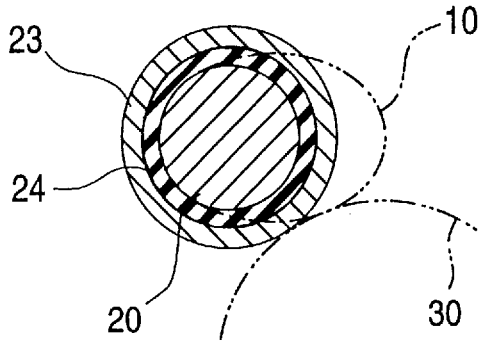
FIGS. 4(*a*) and 4(*b*) show additional supporting means.
Figure 4:
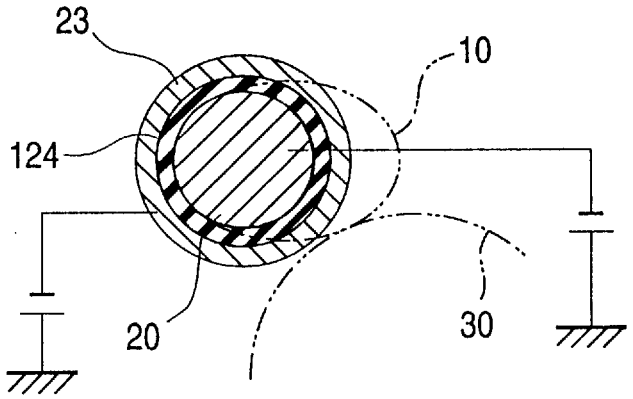

Turning now to FIGS. 4(*a*) to 4(*b*), there are illustrated further means each to secure a stable following-rotation of the conductive tube by using a rotatable supporting member.

In the instance of FIG. 4(*a*), a bearing 23 is used for rotatably supporting the supporting member 20. The inner surface of the bearing 23 is covered with a layer 24 made of material of a small coefficient of friction to the supporting member 20. Such a construction reduces a resistance to the rotation of the conductive tube 10 in the company of the photosensitive drum. The surface of the conductive tube 10 may be covered with a layer 24 made of material of a small coefficient of friction to the bearing 23 for the same purpose.

In the instance of FIG. 4(*b*), an insulating layer 124 is layered on the inner surface of the bearing 23, which rotatably supports the supporting member 20. Voltage is applied to the bearing 23, and voltage of the same polarity as of the voltage applied to the bearing is also applied to the supporting member 20. The resultant electrostatic repulsion reduces a frictional force which acts between them. Alternatively, the layer 124 may be applied to the surface of the supporting member 20 instead of the inner surface of the bearing 23.

Figure 5:
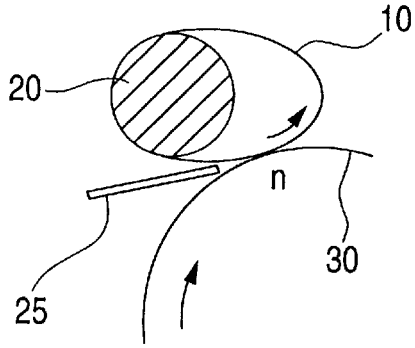
FIGS. 5(*a*) to 5(*d*) show several means for maintaining a fixed discharge gap.
Figure 5:
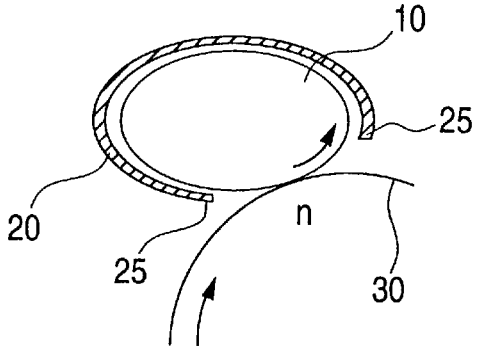
Figure 5:
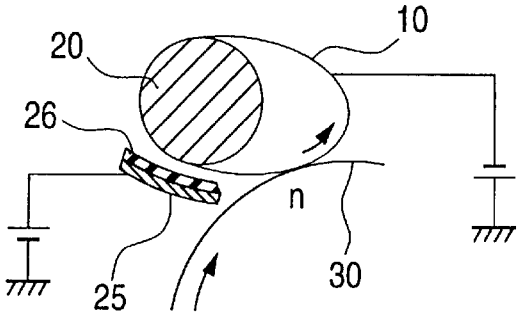
Figure 5:
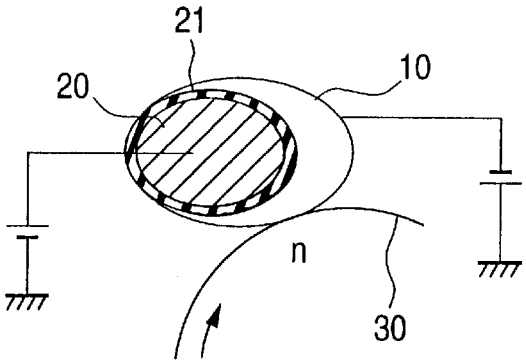

Means to stably maintain a discharge gap, which is formed between the photosensitive drum 30 and the conductive tube 10 is diagrammatically shown in FIGS. 5(*a*) to 5(*d*).

A typical instance of the means to stably maintain a discharge gap is shown in FIG. 5(*a*). In the instance, an auxiliary supporting member 25 is lightly and slidably put into a space between the conductive tube 10 and the photosensitive drum 30 at a location just upstream of the contact area or nip n between them when viewed in the direction of the rotating of the photosensitive drum. The auxiliary supporting member 25 may be a thin, insulating plate or a thin wire. Provision of the auxiliary supporting member 25 holds down a vibration of the conductive tube 10 at that location, to thereby ensure a stable charging operation, and further allows the tolerable variation of the film thickness to be widen.

Two auxiliary supporting members 25 may be located upstream and downstream of the nip n. Further, the auxiliary supporting member 25 may be made of conductive material. In this case, a bias voltage of the same polarity as of the voltage applied to the conductive tube 10 is applied to the conductive auxiliary supporting member 25, whereby the vibration of the conductive tube 10 is electrostatically held down.

In the instance of FIG. 5(*b*), the supporting member for supporting the conductive tube 10 serves also as the auxiliary supporting member. As shown, a supporting member 20 of a small coefficient of friction is shaped in conformity with the conductive tube 10, which rotates together with the photosensitive drum 30, and supports the conductive tube 10 from the outside of the tube. Both ends of the supporting member 20 extend near to the contact area n. Those end portions of the supporting member 20 are used as auxiliary supporting members 25 for holding back the vibration of the conductive tube 10 in the discharging region.

In the instance of FIG. 5(*c*), an auxiliary supporting member 25 made of conductive material is provided along the underside of the conductive tube 10. An insulating layer 26 is layered over the surface of the auxiliary supporting member 25, which faces the conductive tube 10. A bias voltage of the polarity that is opposite to that of the voltage of the conductive tube 10 is applied to auxiliary supporting member 25. The resultant electrostatic attracting force which acts between them holds back the conductive tube 10 that will move away from the auxiliary supporting member 25, to thereby reduce the vibration of the conductive tube 10 in the discharging region.

In a modification of this instance, a bias voltage of the same polarity as of the voltage applied to the conductive tube 10 is applied to the auxiliary supporting member 25. With the resultant electrostatic repulsion, the conductive tube 10 is stably supported.

In the instance of FIG. 5(*d*), a conductive supporting member 20 is covered with an insulating layer 21. A bias voltage of the polarity that is opposite to that of the voltage applied to the conductive tube 10 is applied to the supporting member 20. The conductive tube 10 is electrostatically attracted to the supporting member 20, so that a tension of the conductive tube 10 is further increased in the contact area n. The increased tension holds down the vibration of the conductive tube 10 in the discharging region. If the supporting member 20 is shaped like an ellipse elongated in the tension direction, a reliable support of the conductive tube 10 and the uniform charging are secured.

Figure 6:
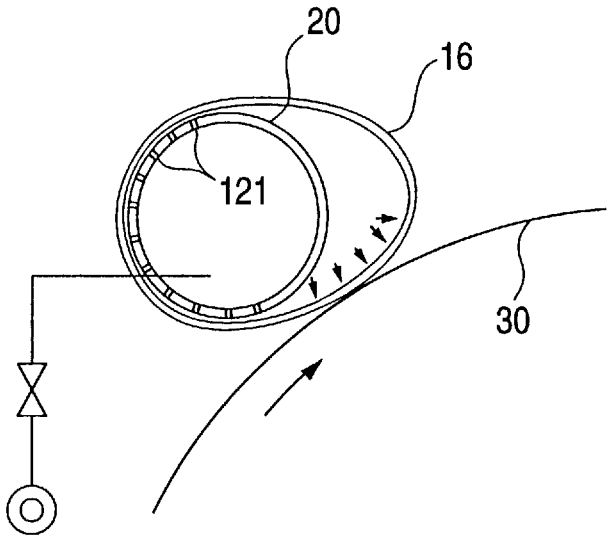
FIG. 6 shows another instance of the means for maintaining a fixed discharge gap.

Another instance of the means which is capable of securing a reliable support of the conductive tube 10 and the uniform charging operation is diagrammatically illustrated in FIG. 6. In this instance, a number of air blow-off holes 121 are formed in at least the surface of the supporting member 20 as a pipe-like member, the surface being made to slidably contact with the conductive tube 10. Air is introduced into the supporting member 20, and blown off through those holes to form an air layer within the conductive tube 10. With the air layer, the conductive tube 10 is supported in a noncontact fashion. Further, expansion of the conductive tube 10 caused by the air pressure holds down the vibration of the conductive tube 10 in the discharging region.

Figure 7:
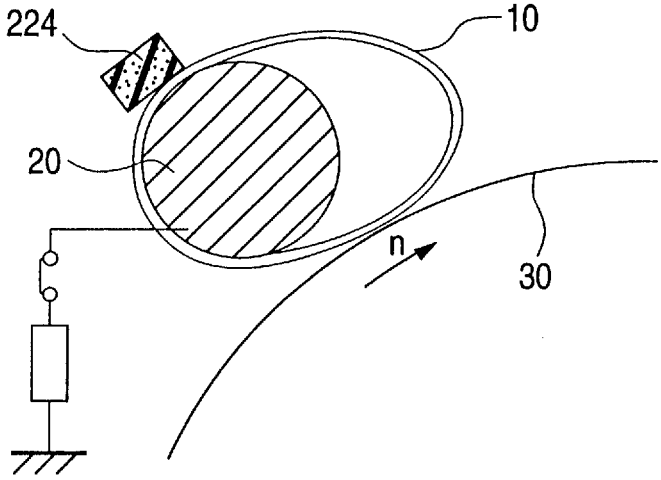
FIG. 7 shows yet another instance of the means for maintaining a fixed discharge gap.

A further instance of the means for stably maintaining a discharge gap is shown in FIG. 7. As shown, a second supporting member 224 is provided on the side of the first supporting member 20 that is opposite to the side thereof facing the photosensitive drum 30 in a state that the conductive tube 10 is put between the first and the second supporting members 224 and 20. The second supporting member 224 is made of soft material, for example, foam material. In the construction, the conductive tube 10 is stretched between the location where the tube is put between the first and the second supporting members and the contact area n. Since the conductive tube 10 is thus tensioned, the conductive tube 10, if it has a slight variation of its thickness, can uniformly charge the surface of the photosensitive drum 30.

Thus, the second supporting member 224 functions to generate a tension in the conductive tube 10. Further, the conductive tube 10, if it is made of foam material, functions to remove the toner attached to the surface of the conductive tube 10. The second supporting member 224 may have a rolled shape, or a shape along the outer circumference of the first supporting member 20.

Figure 8:
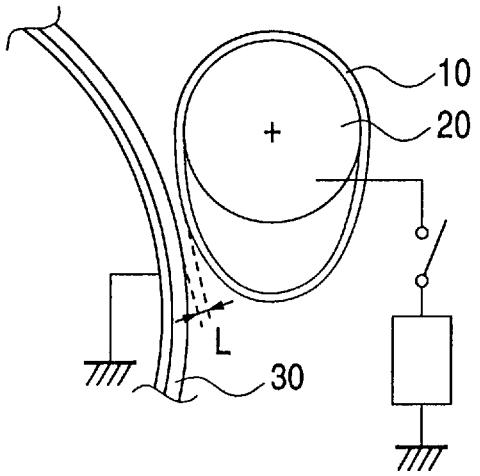
FIGS. 8(*a*) and 8(*b*) show another embodiment of a contact charging device according to the present invention when it is in an operating state and a non-operating state.
Figure 8:
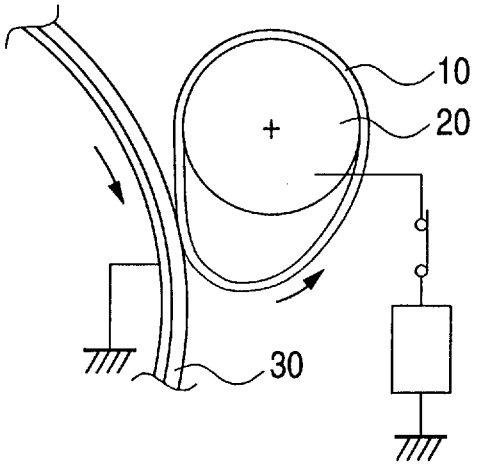

In an embodiment of the invention shown in FIGS. 8(*a*) and 8(*b*), the supporting member 20 is disposed on the side of the photosensitive drum 30 so that when the conductive tube 10 is in an inoperative state, the tube 10 is located apart from the photosensitive drum 30. With such a construction, the product incorporating the contact charging device of the invention is transported while leaving the conductive tube 10 apart from the supporting member 20. Further, such a material that soils the photosensitive drum 30 may be used for the conductive tube 10.

In this case, to bring the conductive tube 10 into contact with the photosensitive drum 30 while resisting the gravity, a large electrostatic attractive force must act therebetween. For this reason, it is necessary to set the distance between the conductive tube 10 in an inoperative state and the photosensitive drum 30 at 5 mm or shorter. Further it is preferable to set the voltage difference between them at 300 V or higher in the absolute value.

A preferable material of the conductive tube 10 satisfies the following conditions: it does not contain such a material to contaminates the photosensitive drum, and after it is released from being compressed, little distortion is left in the material. Examples of the preferable material are resin containing carbon black, or rubber containing the same, such as nylon resin, polyester resin, polycarbonate resin, or polyimide resin, and urethane rubber. A specific example of the conductive tube 10 is a tubular member which is made of a material of 1000 kg/mm$^2$ or smaller in Young's modulus, and is 300 $\mu$m or smaller in thick and 7 mm or larger in the outside diameter. A resistance of the conductive tube 10 is preferably within the range of $10^5$ to $10^9$ Ωcm. If the resistance is so selected, minute defects of the photosensitive drum 30 do not impair the quality of the resultant image. The resistance of the conductive tube 10 is determined depending on the peripheral speed of the photosensitive drum 30. As the peripheral speed becomes large, the upper limit of the resistance value is lowered.

Figure 9:
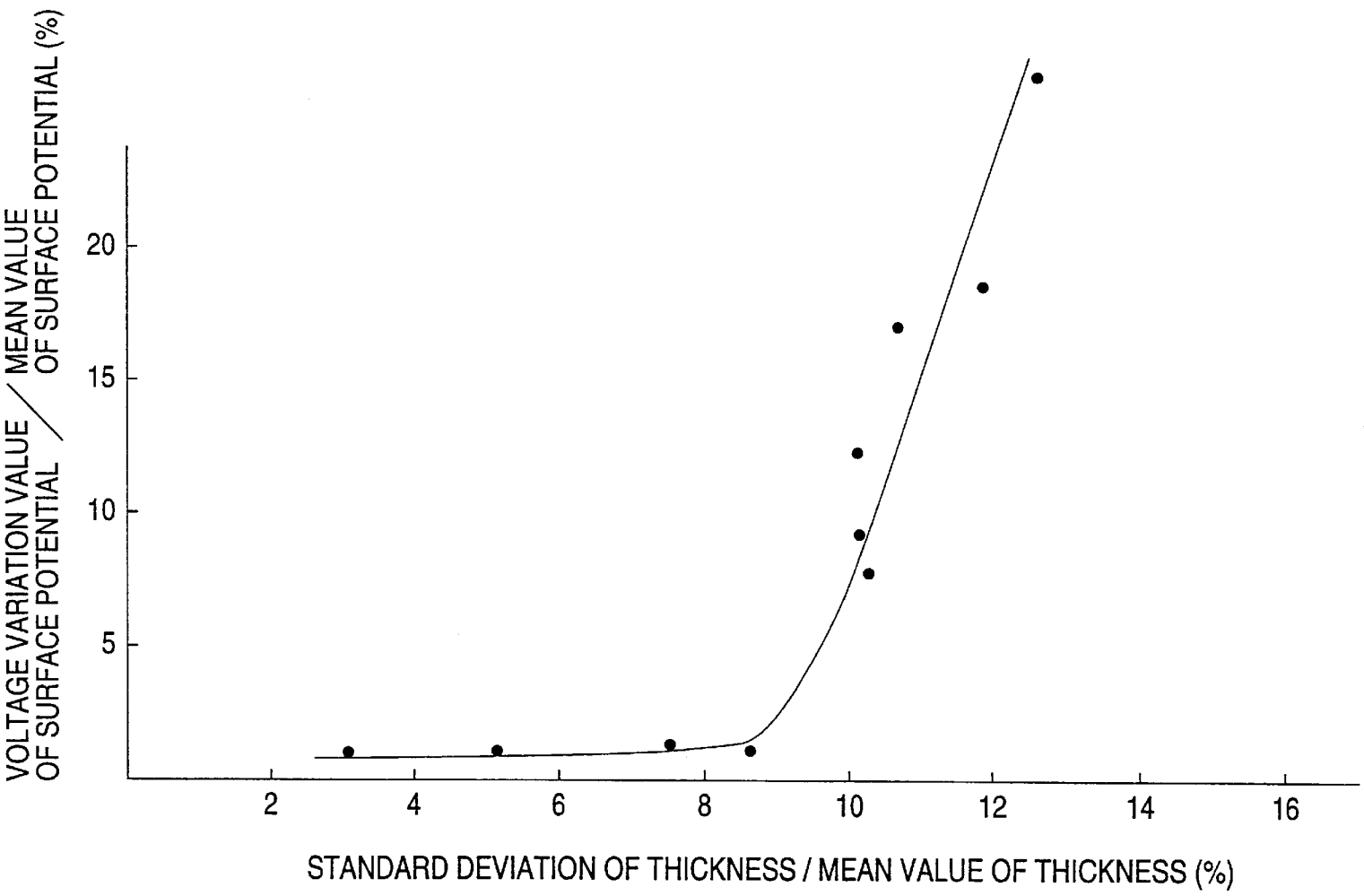
FIG. 9 is a graph showing the relationship between a variation of the film thick of a conductive tube and a variation of the surface potential.

A variation of the thickness of the conductive tube 10, more exactly (standard deviation of the thickness values)/(mean value of the thickness values), must be within 10% (FIG. 9). When the variation of the thickness values exceeds 10%, the charging operation becomes greatly irregular. The surface roughness of the conductive tube 10 where it is brought into contact with the photosensitive drum 30, viz., the 10-pint average roughness defined by JIS0601 (Japanese Industrial Standard), is 5 $\mu$m or smaller. Preferably it is 2 $\mu$m or smaller. If so selected, a further improved uniformity is secured in the charging operation.

The conductive tube 10 may be manufactured in a known method, such as a melt extrusion method or a casting method. If required, it is subjected to a process for forming a required surface roughness.

Figure 10:
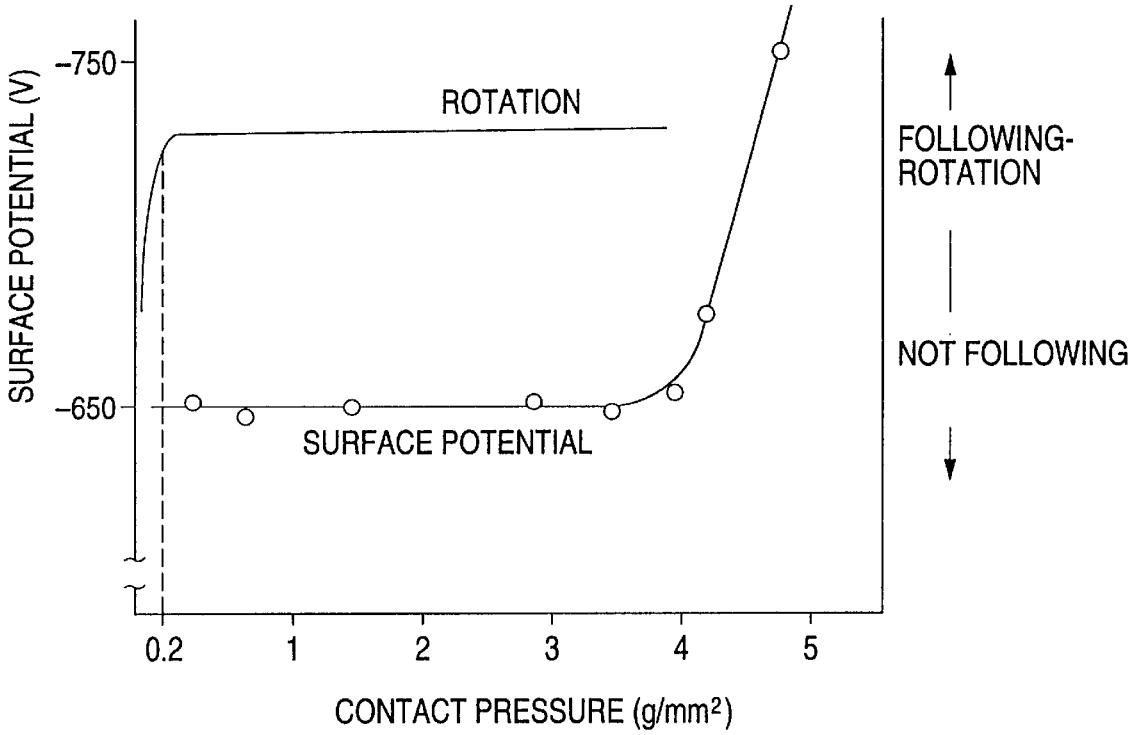
FIG. 10 is graph showing the relationship among the surface potential, the contact pressure, and the following-rotation.

A relationship between the contact pressure of the conductive tube 10 with the photosensitive drum 30 and the surface potential of the photosensitive drum is as shown in FIG. 10. The electrostatic attracting force Fq mainly constitutes the contact pressure. When the electrostatic attracting force Fb is 4 g/mm$^2$ or smaller, the conductive tube 10 can charge the photosensitive drum 30 by using only the discharging operation. When the electrostatic attracting force Fq exceeds the above value, there is observed a tendency that the charging operation by the charge injection is performed concurrently with the charging operation by the discharging operation. The condition that the conductive tube 10 rotates together with the photosensitive drum 30 without any slipping motion of it to the photosensitive drum is that the electrostatic attracting force Fq of the conductive tube 10 to the photosensitive drum 30 is 0.2 g/mm$^2$ or larger.

The conductive tube 10 must be straight over the entire width of the effective image area before and after the contact area n where the conductive tube 10 is put into contact with the photosensitive drum 30. If the straightness of the conductive tube is 1/10 of the diameter of the conductive tube or less, a stable contact of the conductive tube 10 with the photosensitive drum 30 is secured. The contact of the conductive tube 10 with the photosensitive drum 30 is more stable if the straightness of the part of the supporting member 20 where it is put into contact with the conductive tube 10 is 0.1 mm or less, the straightness of the photosensitive drum 30 is 0.1 mm or less, and the parallelism of the photosensitive drum 30 and the supporting member 20 is 0.1 mm or less.

The experiment conducted by us showed that a tolerance of the straightness of the conductive tube 10 is 1/10 as large as the diameter of the conductive tube 10.

The experiment follows. Conductive nylon tubes a to f of different straightness value were manufactured (Table 1). The resistance of each tube was adjusted to $10^7$ Ωcm by adding carbon black to the material of the tube.

Specifications of each of the nylon tubes were: the diameter was 10 mmϕ, the thickness was 30 $\mu$m, the Young's modulus was 110 kg/mm$^2$, and the length was 230 mm. A first supporting member manufactured was 7 mmϕ in diameter and 240 mm long and 0.2 mm in straightness made of stainless steel. The first supporting member was disposed 1 mm apart from the photosensitive drum. A second supporting member was manufactured by bonding a fluorine resin tape of 150 $\mu$m thick on the surface of a sponge of 3 mm thick. The conductive nylon tube was inserted between the first and the second supporting members by a line pressure of 1 g/cm. A photosensitive drum was manufactured such that a function-separation, negative charging type organic photoconductive layer of 20 $\mu$m thick was layered on the surface of an aluminum pipe of 60 mmϕ diameter. The conductive nylon tube, nipped between the first and the second supporting members, was brought into contact with the photosensitive drum rotating at 30 mm/sec (peripheral speed). A DC voltage at −1150 V was applied to the first supporting members, to thereby charge the photosensitive drum. A surface potential of the photosensitive drum such that the surface potential of the photosensitive drum charges at about −600 V was measured. The contact charging device thus constructed was incorporated into an image forming apparatus of 600 dpi. The image forming apparatus was operated to form a dot pattern on a plain paper of A4 size. The resultant dot pattern images were evaluated.

The results of the image evaluation are as shown in the following table.

TABLE 1

| Tube No. | Straightness | Surface potential variation (V) | Evaluation |
|---|---|---|---|
| a | 0.1 | +5 | ◎ |
| b | 0.5 | +11 | ◎ |
| c | 0.9 | +25 | ○ |
| d | 1.0 | +30 | Δ |
| e | 1.1 | +50 | x |
| f | 1.2 | +100 | x |

In the above table,

◎: Image free from a density irregularity,

○: Within the tolerable range,

Δ: A density difference is present, but it is very near to the lower limit of the tolerable range, and x: A density difference is large to be out of the tolerable range.

As seen from Table 1, a good charging operation is secured when the straightness of the conductive tube is 1/10 as large as the diameter of the tube.

Conductive tube of 10 mm in diameter and 1.0 mm in straightness was manufactured. Supporting members g to i of different straightness values were manufactured. The experiment similar to the above-mentioned one was conducted using the conductive tube and the supporting members. The surface potential variation was measured and the resultant images were evaluated The results of the experiment are as shown in Table 2.

TABLE 2

| Support member | Straightness | Surface potential variation (V) | Evaluation |
|---|---|---|---|
| g | 0.2 | ±30 | Δ |
| h | 0.15 | ±28 | Δ |
| i | 0.1 | ±20 | ○ |

As seen from the above table, the image quality is remarkably improved when the straightness of the supporting member is 0.1 mm or less. This fact implies that as the result of improving the straightness of the supporting member, the conductive tube is rotated together with the photosensitive drum without any meandering of the conductive tube.

As seen from the foregoing description, a supporting member that is disposed apart from a member to be charged, supports an endless conductive member electrostatically attracted onto the electrified body in a state that the conductive member is stretched and may be rotated together with a photosensitive. Therefore, the conductive member uniformly and effectively charges the electrified body without impairing the member to be charged, and by minimizing a shift of the contact position where the conductive member is in contact with the electrified body and a vibration of the conductive member in the discharging area.

What is claimed is:

1. A contact charging device comprising:

a member to be charged rotatably provided;

a conductive member having a soft endless thin film shape, for charging or discharging said member to be charged such that said conductive member is electrostatically attracted to said member to be charged as said member to be charged rotates; and a supporting member, disposed apart from said member to be charged, for holding said conductive member while resisting the electrostatic attracting force such that said conductive member is stretched, to thereby allow said conductive member to rotate following the rotation of said member to be charged.

2. The contact charging device according to claim 1, wherein the variation of the film thickness of said conductive member is within 10%.

3. The contact charging device according to claim 1, wherein a tolerance value of the straightness of said conductive member when viewed in the width direction thereof is 1/10 or less as large as the diameter of said conductive member.

4. The contact charging device according to claim 1, wherein said supporting member is fixed.

5. The contact charging device according to claim 1, wherein said supporting member is rotatable together with said conductive member.

6. The contact charging device according to claim 1, wherein said conductive member is disposed apart from said member to be charged when a voltage is not applied to said conductive member.

7. The contact charging device according to claim 1, further comprising:

a member for holding down vibration of the conductive member near where said conductive member contacts the member to be charged, said member for holding down vibration being disposed at a position near to where said conductive member is electrostatically attracted to said member to be charged.

8. The contact charging device according to claim 1, wherein said conductive member includes an inner layer and an outer layer attached on said inner layer, said inner layer having a small friction coefficient to said supporting member, said outer layer being conductive and having a large friction coefficient to said member to be charged.

9. The contact charging device according to claim 1, wherein said supporting member is conductive and has an insulating layer on the surface thereof, and a bias voltage is applied to said supporting member.

10. The contact charging device according to claim 1, wherein said supporting member has an ellipse shape in section.

11. The contact charging device according to claim 1, wherein said supporting member has a hollow cylindrical shape and air holes on said hollow cylindrical shape.

12. The contact charging device according to claim 1, wherein the contact pressure which acts between said conductive member and said member to be charged is set from 0.2 g/mm$^2$ to 4 g/mm$^2$.

13. The contact charging device according to claim 7, wherein said member for holding down vibration is a thin insulating plate.

14. The contact charging device according to claim 7, wherein said member for holding down vibration is a thin wire.

15. The contact charging device according to claim 7, wherein said member for holding down vibration is formed as a part of said supporting member, said supporting member being shaped in conformity with the conductive member to support the conductive member from outside the conductive member;

the supporting member having two ends which each extend near to said position near to where said conductive member is electrostatically attracted to said member to be charged, so as to form said member for holding down vibration.

16. The contact charging device according to claim 7, wherein said member for holding down vibration is an auxiliary supporting member made of conductive material disposed along the underside of the conductive member.

17. The contact charging device according to claim 2, wherein said conductive member includes an inner layer and an outer layer attached on said inner layer, said inner layer having a small friction coefficient to said supporting member, said outer layer being conductive and having a large friction coefficient to said member to be charged.

18. The contact charging device according to claim 4, wherein said conductive member includes an inner layer and an outer layer attached on said inner layer, said inner layer having a small friction coefficient to said supporting member, said outer layer being conductive and having a large friction coefficient to said member to be charged.

* * * * *